US005455012A

United States Patent [19]

Machida et al.

[11] Patent Number: 5,455,012

[45] Date of Patent: Oct. 3, 1995

[54] EXHAUST GAS PURIFYING APPARATUS

[75] Inventors: Minoru Machida; Toshio Yamada, both of Nagoya, Japan

[73] Assignee: NGK Insulators, Ltd., Japan

[21] Appl. No.: 216,946

[22] Filed: Mar. 24, 1994

[30] Foreign Application Priority Data

Mar. 26, 1993 [JP] Japan ..... 5-068554
Mar. 8, 1994 [JP] Japan ..... 6-036986

[51] Int. Cl.[6] ..... B01D 53/36; F01N 3/28

[52] U.S. Cl. ..... 422/180; 422/169; 422/170; 422/171; 422/177; 60/299; 60/285; 60/289

[58] Field of Search ..... 422/170–172, 422/177–180, 169, 190, 211, 188; 60/276, 285, 289, 299

[56] References Cited

U.S. PATENT DOCUMENTS

| | | | |
|---|---|---|---|
| 4,072,471 | 2/1978 | Morgan et al. | 422/180 |
| 4,321,792 | 5/1982 | Achard | 60/276 |
| 4,541,995 | 9/1985 | Kim et al. | 60/299 |
| 5,108,716 | 4/1992 | Nishizawa | 422/180 |
| 5,235,956 | 8/1993 | Yoshizaki | 60/289 |
| 5,331,810 | 7/1994 | Ingermann | 60/299 |

FOREIGN PATENT DOCUMENTS

| | | | |
|---|---|---|---|
| 0283220 | 9/1988 | European Pat. Off. | F01N 3/28 |
| 2367188 | 5/1978 | France | F01N 3/15 |
| 2450946 | 10/1980 | France | F01N 3/10 |
| 1371941 | 10/1974 | United Kingdom | F01N 3/14 |

OTHER PUBLICATIONS

Patent Abstracts of Japan, vol. 15, No. 473 (M–1185) Nov. 29, 1991 & JP–A–03 202 613 (Komatsu Ltd.) Sep. 4, 1991.

*Primary Examiner*—Robert J. Warden
*Assistant Examiner*—Hien Tran
*Attorney, Agent, or Firm*—Parkhurst, Wendel & Rossi

[57] ABSTRACT

In an exhaust gas purifying apparatus including first and second exhaust converters composed of a honeycomb catalytic substrate, arranged in sequence from an exhaust manifold downstream along exhaust gas flow of an engine, wherein the catalytic substrate of the first converter has a heat capacity of not exceeding 0.5 J/K per 1 $cm^3$ in temperatures ranging from room temperature up to 300° C., and the catalytic substrate of the second converter has a geometric surface area of at least 25 $cm^2/cm^3$. The first converter purifies exhaust gas immediately after starting up and before completion of warming up of the engine, and the second converter further purifies noxious contents still remaining as being beyond capacity of the first converter.

10 Claims, 8 Drawing Sheets

EXHAUST GAS PURIFYING APPARATUS

BACKGROUND OF THE INVENTION

1. Field of the Invention

The present invention relates to exhaust gas purifying apparatuses for internal combustion engines (hereinafter referred to as "engines") to be used in automobiles or the like.

2. Description of the Prior Art

Regulations for exhaust gas of automobiles are becoming stricter year by year. Particularly, it is becoming more and more severely requested to decrease noxious contents in exhaust gas, such as carbon monoxide CO, hydrocarbons HC, nitrogen oxides $NO_x$ or the like, by purifying the exhaust gas discharged immediately after starting up and before completion of warming up of engines. As a countermeasure therefor, there has been known an exhaust gas purifying apparatus to be mounted on the exhaust port of the engine, which comprises a first exhaust converter having a small capacity and a second exhaust converter having a large capacity, for converting the noxious contents into innoxious components. In such an exhaust gas purifying apparatus, the noxious contents are decreased by the first exhaust converter wherein a high temperature is readily attained and thereby a catalyst is rapidly activated, mainly immediately after starting up and before completion of warming up of the engine and then by the second exhaust converter having a larger capacity after the warming up of the engine has been completed. Among these exhaust gas purifying apparatuses, some have been designed to feed air at an appropriate feed rate into exhaust gas to improve an exhaust gas purification efficiency.

However, in the above-mentioned exhaust gas purifying apparatus there has been posed a problem such that since the first exhaust converter comprises a catalytic substrate having a heat capacity not small enough to sufficiently activate the catalyst while the engine is under the condition between immediately after starting up and before completion of warming up, a good exhaust gas purification efficiency cannot be obtained. In this specification, the term "heat capacity" is meant by a heat capacity of a catalytic substrate including exhaust flow passages formed therein (hereinafter, the exhaust flow passage is referred to as "cell").

SUMMARY OF THE INVENTION

The present invention which has been accomplished in order to solve such a problem is aimed to thoroughly remove noxious contents in exhaust gas, such as carbon monoxide CO, hydrocarbons HC, nitrogen oxides $NO_x$ or the like, by converting these into innoxious components immediately after starting up and before completion of warming up of engines and also after the warming up has been completed.

The exhaust gas purifying apparatus of the present invention was developed to solve the above problem and comprises first and second exhaust converters arranged in sequence from an exhaust manifold towards the downstream exhaust gas flow of an engine, each having a catalytic substrate formed in a honeycomb structure wherein a plurality of cells are contiguously bored therethrough in the axial direction of the catalytic substrate, each of the cells being defined by a partition wall, and is characterized in that the catalytic substrate of the first exhaust converter has a heat capacity of not exceeding 0.5 J/K per 1 $cm^3$ in temperatures ranging up to a temperature at least high enough to activate a catalytic reaction, i.e., in the temperature range between room temperature and 300° C., and the catalytic substrate of the second exhaust converter has a geometric surface area of at least 25 $cm^2/cm^3$. Throughout this specification, the term "geometric surface area" should be understood to mean the surface area of the partition walls defining the cells, per unit volume of a catalytic substrate.

Further, in the exhaust gas purifying apparatus according to the present invention, it is desired that the partition walls defining the cells of the catalytic substrate in the first exhaust converter are at most 0.20 mm thick and those in the second exhaust converter are at most 0.15 mm thick.

Furthermore, both in the first and second exhaust converters of the exhaust gas purifying apparatus according to the present invention, the number of the cells in the catalytic substrate is preferably at least 50 per 1 $cm^2$ of a plane perpendicular to the longitudinal axes of the cells. Hereinafter, the number of cells per 1 $cm^2$ of a plane perpendicular to the longitudinal axes of the cells in the catalytic substrate is referred to as "cell density".

Furthermore, the exhaust gas purifying apparatus according to the present invention may further comprise at least one additional exhaust converter arranged downstream in the exhaust gas flow from the second exhaust converter in order to increase the exhaust gas purification efficiency.

Furthermore, in the exhaust gas purifying apparatus according to the present invention, it is preferred that at least one of the first and second exhaust converters has a catalytic substrate made of a ceramic.

Furthermore, the exhaust gas purifying apparatus according to the present invention is preferably provided with an air introducing device which can feed air at an arbitrary feed rate into the gas flow between the exhaust manifold and the first exhaust converter.

Furthermore, in the exhaust gas purifying apparatus according to the present invention, it is preferred that a gas detector is arranged between the exhaust manifold and the first exhaust converter, to detect the condition of the exhaust gas composition and output a signal for thereby controlling the fuel combusting condition.

Furthermore, in the exhaust gas purifying apparatus according to the present invention, it is preferred that a gas detector is arranged between the exhaust manifold and the first exhaust converter, to detect the condition of the exhaust gas composition and output a signal for thereby controlling the fuel combusting condition, and an air introducing device is provided to feed air at an arbitrary feed rate into at least one of the gas flows between the exhaust manifold and the gas detector and between the gas detector and the first exhaust converter.

Furthermore, in the exhaust gas purifying apparatus according to the present invention, it is preferred that the air introducing device can feed air at an arbitrary feed rate corresponding to the signal output from the gas detector.

Furthermore, in the exhaust gas purifying apparatus according to the present invention, the gas detector is preferably an oxygen sensor.

According to the exhaust gas purifying apparatus of the present invention, the exhaust converter system is divided into the first and second exhaust converters both comprising a honeycomb structure, the catalytic substrate of the first converter is formed to have a small heat capacity and the catalytic substrate of the second converter is formed to have a sufficiently large geometric surface area. Accordingly, engines equipped with the exhaust gas purifying apparatus according to the present invention can maintain a good exhaust gas purification efficiency both before and after completion of warming up. Therefore, the apparatus of the present invention is effective to mitigate air pollution due to noxious contents in exhaust gas.

Additionally, according to the exhaust gas purifying apparatus of the present invention, the exhaust gas purification efficiency can be further improved by arranging an air introducing device for feeding air at an arbitrary feed rate into gas flow between the exhaust manifold and the first exhaust converter.

BRIEF DESCRIPTION OF THE DRAWINGS

The above and other objects, features and advantages of the present invention will become more apparent from reading the following description of the preferred embodiments taken in connection with the accompanying drawings, wherein.

DESCRIPTION OF THE PREFERRED EMBODIMENTS

Preferred embodiments of the present invention will be explained based on the drawings hereinbelow.

Figure 1:
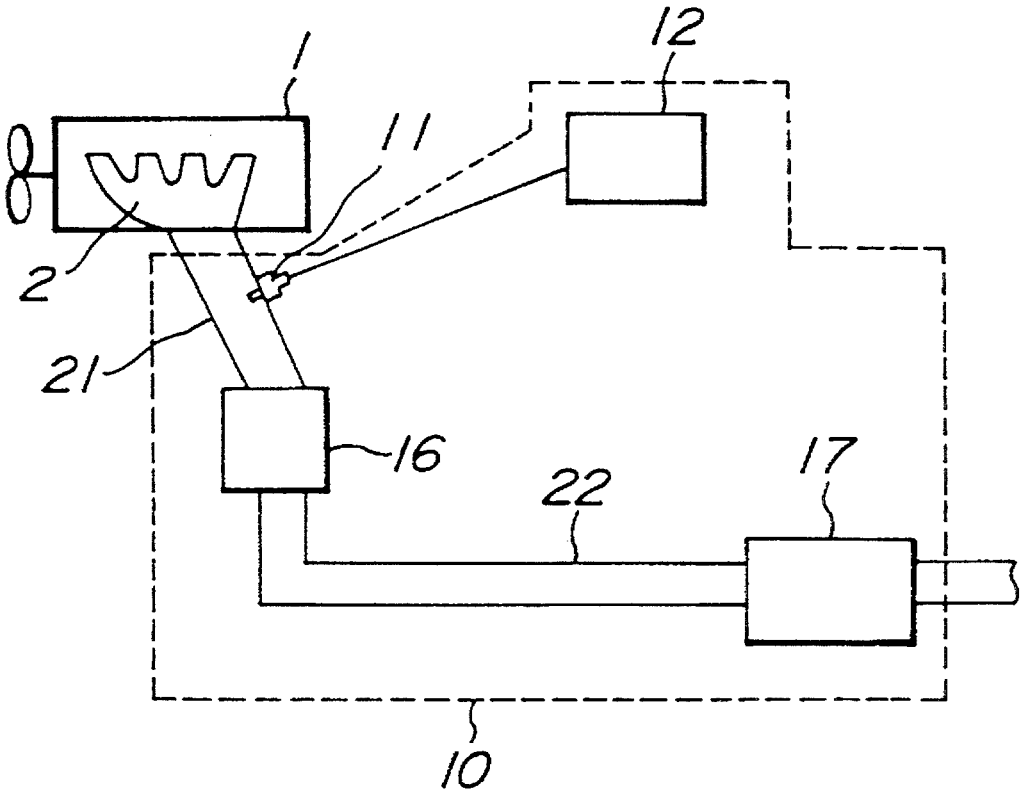
FIG. 1 is a schematic view illustrating an exhaust gas flow route in an engine wherein an embodiment of the exhaust gas purifying apparatus according to the present invention is applied.

FIG. 1 shows an exhaust gas flow route in an engine wherein an embodiment of the exhaust gas purifying apparatus according to the present invention is applied.

In FIG. 1, the flow route of exhaust gas discharged from an automobile engine includes an engine body 1, an exhaust manifold 2 and an exhaust gas purifying apparatus 10.

The exhaust gas purifying apparatus 10 comprises an oxygen sensor 11, an engine control computer 12, an exhaust pipe 21, a first exhaust converter 16, an intermediate exhaust pipe 22, and a second exhaust converter 17. The oxygen sensor 11, the first exhaust converter 16 and the second exhaust converter 17 are arranged in this order toward the downstream flow of the gas collected by the exhaust manifold 2. The oxygen sensor 11 outputs a signal corresponding to the oxygen partial pressure in the exhaust gas immediately after the exhaust gas is collected by the exhaust manifold 2. The engine control computer 12 receives the signal output from the oxygen sensor 11 and determines a feed rate of fuel to be supplied to the engine. The exhaust gas collected by the exhaust manifold 2 is forwarded through the exhaust pipe 21 to the first exhaust converter 16 wherein the exhaust gas is purified. The exhaust gas which has passed through the first exhaust converter flows through the intermediate exhaust pipe 22 into the second exhaust converter 17 wherein the exhaust gas is further purified.

The oxygen sensor 11 to function as a gas detector is arranged in the exhaust pipe 21 between the exhaust manifold 2 and the first exhaust converter 16. As this sensor is employed a dual signal output type which outputs two kinds of signals, i.e., a rich signal indicating a rich mixture and a lean signal indicating a lean mixture with respect to the theoretical air/fuel mixture ratio (Ga/Gf). Alternatively, a Ga/Gf sensor of a whole region type also can be employed which outputs a signal in proportion to the oxygen partial pressure in the exhaust gas collected by the exhaust manifold 2.

The first exhaust converter 16 is preferred to comprise a catalytic substrate of a honeycomb structure made of cordierite which has a number of cells and a small capacity. Platinum Pt typical as a metallic catalyst is carried on the catalytic substrate. The heat capacity of the catalytic substrate is preferred to be at most 0.5 J/K, more preferably at most 0.4 J/K, per 1 $cm^3$ in the temperature range from at least room temperature to 300°C. This heat capacity can be appropriately controlled by adequately selecting the partition wall thickness of cells, cell density, porosity and the like, of the catalytic substrate. A preferable partition wall thickness of cells is at most 0.20 mm, more preferably at most 0.15 mm, and a preferable cell density is at least 50 cells/$cm^2$, more preferably at least 65 cells/$cm^2$. Alternatively, as the metallic catalyst, rhodium Rh, palladium Pd or the like also can be used in lieu of or in addition of platinum Pt.

The second exhaust converter 17 is preferred to comprise a catalytic substrate of a honeycomb structure made of cordierite which has a number of cells and a large capacity. The catalytic substrate carries platinum Pt typical as a metallic catalyst. The geometric surface area of the catalytic substrate is preferred to be at least 25 $cm^2/cm^3$, more preferably at least 30 $cm^2/cm^3$. This geometric surface area can be appropriately controlled by adequately selecting the partition wall thickness of cells and the cell density. A preferable partition wall thickness of cells is at most 0.15 mm, and a preferable cell density of the catalytic substrate is at least 50 cells/$cm^2$, more preferably at least 65 cells/$cm^2$. Alternatively, as the metallic catalyst, rhodium Rh, palladium Pd or the like also can be used in lieu of or in addition to platinum Pt.

Figure 12:
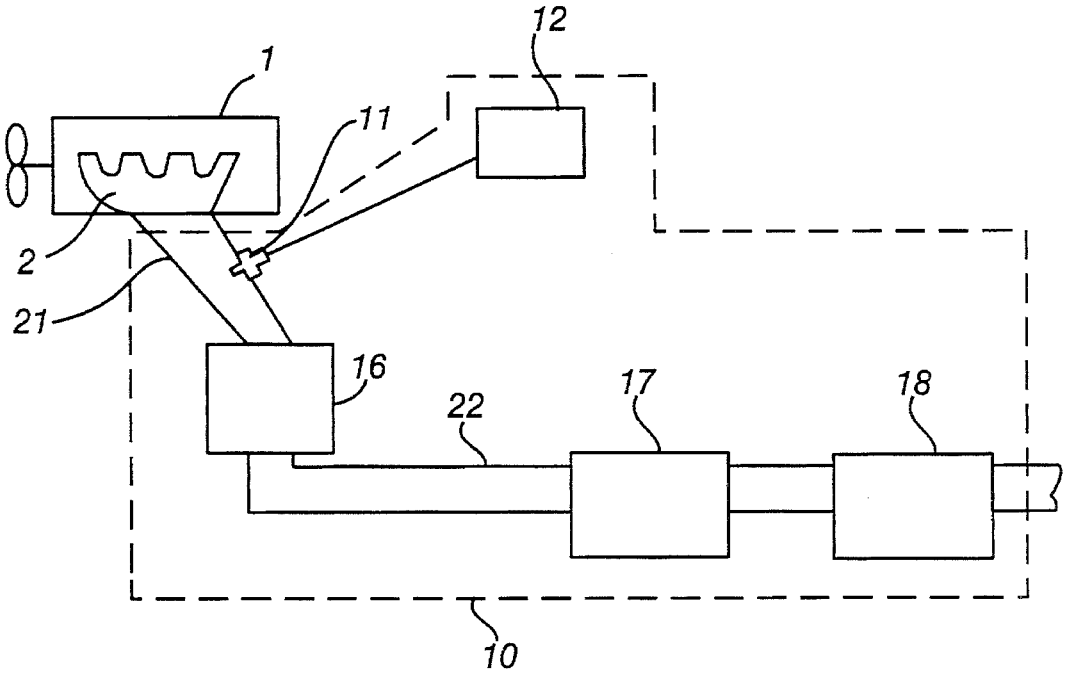
FIG. 12 is a schematic view illustrating an exhaust gas flow route in an engine which is similar to FIG. 1, but wherein the exhaust gas purifying apparatus therein includes an additional exhaust converter.

The schematic view shown in FIG. 12 is identical to that of FIG. 1, but includes an additional exhaust converter 18.

The process of purifying the exhaust gas discharged from the engine body 1 will be explained hereinbelow.

The exhaust gas discharged from the engine body 1 is collected by the exhaust manifold 2 and transferred into the exhaust pipe 21. The oxygen sensor 11 detects the oxygen partial pressure in the exhaust gas in the exhaust pipe 21 and gives a rich signal or a lean signal to the engine control computer 12. According to the output signal, the engine control computer 12 regulates the feed rate of the fuel so as to achieve an optimal air/fuel mixture ratio (Ga/Gf).

Since the first exhaust converter 16 has a small capacity and comprises a catalytic substrate having a small heat capacity, its temperature is rapidly raised by exhaust gas passing therethrough and the catalyst is activated even when the engine is in the condition of immediately after starting up and before completion of warming up. Accordingly, a good exhaust gas purification efficiency can be maintained even during starting up the engine. The exhaust gas purified in the first exhaust converter 16 flows through the intermediate exhaust pipe 22 into the second exhaust converter 17.

The second exhaust converter 17, since it has a large capacity and comprises a catalytic substrate having a large geometric surface area, can efficiently purify carbon monoxide CO, hydrocarbons HC and nitrogen oxides $NO_x$ which still remain in the exhaust gas as being beyond capacity of the first exhaust converter.

In the above-described embodiment of the present invention, a good exhaust gas purification efficiency can be maintained, no matter whether the warming up of the engine body 1 immediately after starting up has been completed or not.

Next, experimental data will be explained in reference to FIGS. 2~7.

Figure 2:
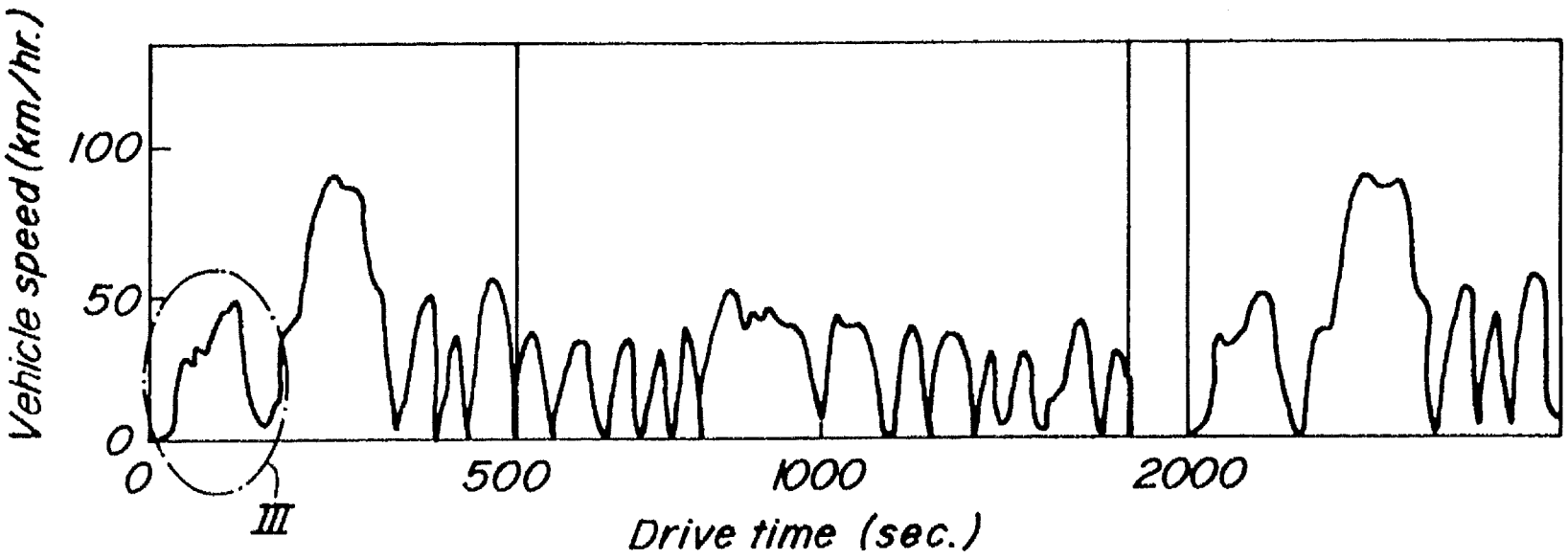
FIG. 2 is a drive chart for determining an exhaust gas purification efficiency of an automobile, which shows a relation between driving time and vehicle speed.

In Experiments 1~4, the quantity and purification efficiency of exhaust hydrocarbons HC were determined when a 2,000 cc automobile was driven according to the drive pattern shown in FIG. 2. The catalytic substrates of the first and second exhaust converters were both made of cordierite and had constant capacities of 700 $cm^3$ and 1700 $cm^3$, respectively. The employed oxygen sensor could output a rich signal or a lean signal corresponding to the oxygen partial pressure in the exhaust gas.

Further, in these experiments, the metallic catalysts carried by the substrates were equalized in quantity among all the first exhaust converters and also among all the second exhaust converters, respectively.

(Experiment 1)

Figure 3A:
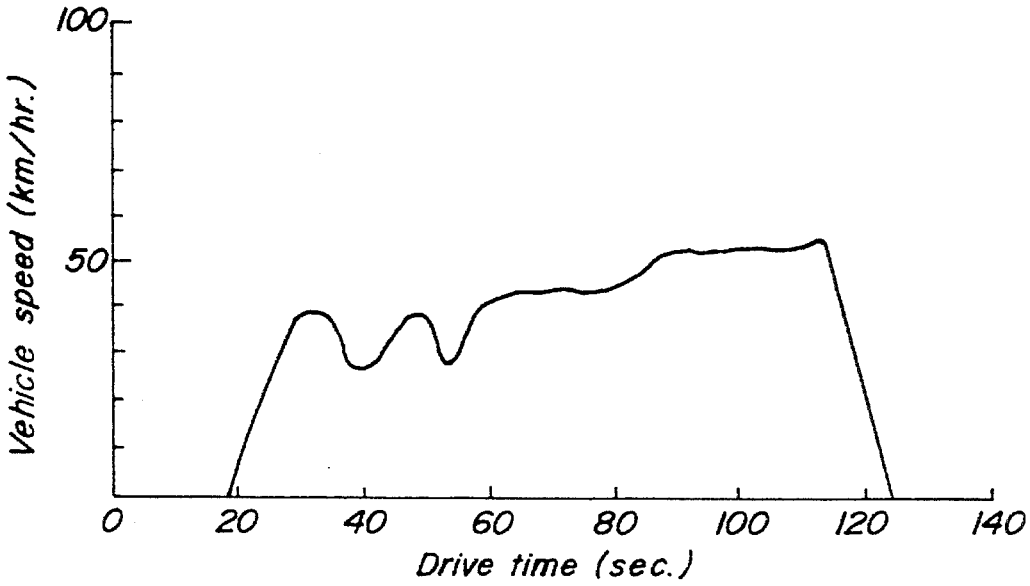
FIG. 3A is an enlargement of the portion III in FIG. 2.

FIG. 3A is an enlargement of the portion circled by the chain line III in the drive chart shown in FIG. 2. As shown in FIG. 3A, when an automobile is operated according to the drive pattern shown in FIG. 2, about 80% in quantity of the total exhaust hydrocarbons HC is discharged within about 140 seconds after starting up the engine. Therefore, the performance of the exhaust gas purifying apparatus depends largely upon the hydrocarbon HC purification efficiency in this period of time.

Figure 3B:
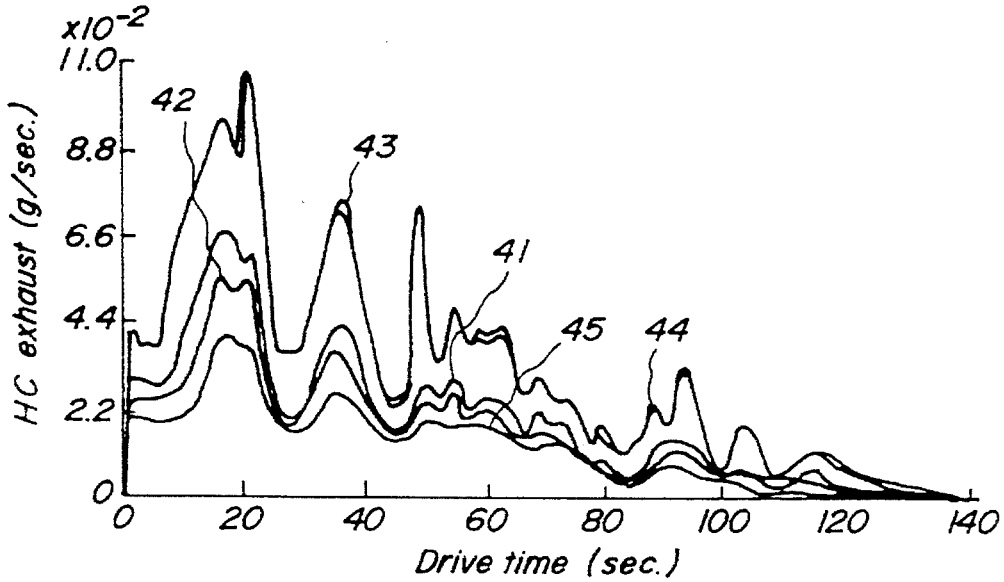
FIG. 3B is a characteristic chart showing relations between driving time and quantities of exhaust hydrocarbons HC within the range shown in FIG. 3A, according to Examples 1, 2 and 3 of the invention and Comparative Examples 1 and 2.

FIG. 3B shows the result in that the quantity of the exhaust hydrocarbons HC was determined under the condition shown in Table 1, within the range shown in FIG. 3A. The graphs 41, 42, 43 and 44 show the results of measurements in Example 1, Example 2, Comparative Example 1 and Comparative Example 2, respectively.

TABLE 1

| Particular | Heat Capacity/ $cm^3$ of First Exhaust Converter (J/K) | Geometric Surface Area of Second Exhaust Converter ($cm^2/cm^3$) | Oxygen Sensor | Air Introducing Device |
|---|---|---|---|---|
| Example 1 | 0.5 | 25 | Rich and lean dual signals output type | Nil |
| Example 2 | 0.28 | 25 | Rich and lean dual signals output type | Nil |
| Example 3 | 0.5 | 25 | All region Ga/Gf type, air excess ratio: 1.05 ± 0.05 | Attached |
| Comparative Example 1 | 0.7 | 20 | Rich and lean dual signals output type | Nil |
| Comparative Example 2 | 0.7 | 25 | Rich and lean dual signals output type | Nil |

It is understood that in the results of measurement in Examples 1 and 2, respectively shown by the graphs 41 and 42, the quantities of the exhaust hydrocarbons HC are fairly small as compared with Comparative Examples 1 and 2, respectively shown by the graphs 43 and 44.

In explained below Experiments 2~4, a dual signal output type oxygen sensor which outputs a rich signal or a lean signal corresponding to the oxygen partial pressure in exhaust gas was used. Further, with respect to the first exhaust converter, the heat capacity per 1 $cm^3$ of the catalytic substrate was represented by the maximal value in the range from room temperature to 300° C.

(Experiment 2)

With changing the heat capacity per 1 $cm^3$ of the catalytic substrate in the first exhaust converter and the geometric surface area of the catalytic substrate in the second exhaust converter, changes of the hydrocarbon HC purification efficiency were measured. With respect to the heat capacity per 1 $cm^3$ of the catalytic substrate in the first exhaust converter, a desired value was obtained by changing the cell density in the range from 65 cells/$cm^2$ to 200 cells/$cm^2$ and the porosity in the range from 7% to 28% while the partition wall thickness was kept constant, in the catalytic substrate. Alternatively, with respect to the geometric surface area of the catalytic substrate in the second exhaust converter, a desired value was obtained by changing the cell density while the partition wall thickness was kept constant at 0.13 mm. The results of the experiments are shown in FIG. 4.

Figure 4:
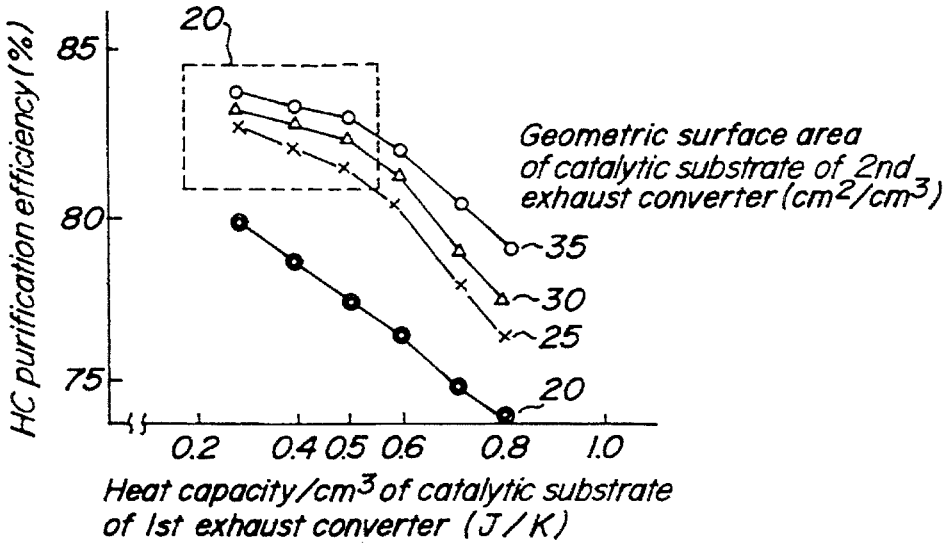
FIG. 4 is a characteristic diagram showing relations of the hydrocarbon HC purification efficiency with the heat capacity per 1 $cm^3$ of the catalytic substrate of the first exhaust converter in conjunction with the geometric surface area of the catalytic substrate of the second exhaust converter, in the embodiment of the exhaust gas purifying apparatus of the present invention.

In FIG. 4, it is understood that the hydrocarbon HC purification efficiencies are extremely high in the range surrounded with the dotted line 20 wherein the heat capacity per 1 $cm^3$ of the catalytic substrate in the first exhaust converter is 0.5 J/K or less and the geometric surface area of the catalytic substrate in the second exhaust converter is 25 $cm^2/cm^3$ or more, so that converters comprising catalytic substrates within the above range are preferred for providing good exhaust gas purifying apparatuses. Moreover, further improved exhaust gas purifying apparatuses were obtained in the range wherein the heat capacity per 1 $cm^3$ of the catalytic substrate in the first exhaust converter was 0.4 J/K or less and the geometric surface area of the catalytic substrate in the second exhaust converter was 30 $cm^2/cm^3$ or more.

In these experiments, only metallic catalysts were used and the heat capacity per 1 $cm^3$ of the substrate with the catalysts was 1.5 times that of the substrate alone. Further, changing the catalyst carrying condition, a catalytic substrate with the catalysts which had a heat capacity per unit volume of the substrate of 1.3 times that of the substrate alone was prepared. This catalytic substrate was tested and the same result was obtained.

Figure 5:
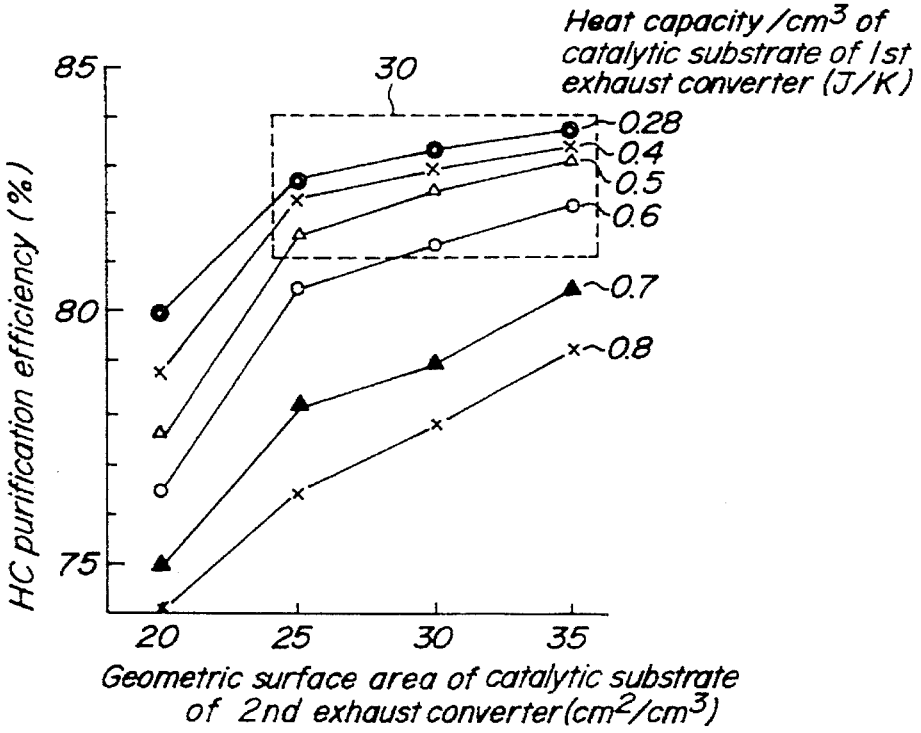
FIG. 5 is a characteristic diagram showing relations of the hydrocarbon HC purification efficiency with the geometric surface area of the catalytic substrate of the second exhaust converter in conjunction with the heat capacity per 1 $cm^3$ of the catalytic substrate of the first exhaust converter, in the embodiment shown in FIG. 4.

FIG. 5 is a diagram showing plots of the hydrocarbon HC purification efficiency when abscissae of the heat capacity per 1 $cm^3$ of the catalytic substrate in the first exhaust converter were replaced by abscissae of the geometric surface area of the catalytic substrate in the second exhaust converter.

In FIG. 5, it is understood that the hydrocarbon HC purification efficiencies are extremely high in the range surrounded with the dotted line 30 wherein the heat capacity per 1 $cm^3$ of the catalytic substrate in the first exhaust converter is 0.5 J/K or less and the geometric surface area of the catalytic substrate in the second exhaust converter is 25 $cm^2/cm^3$ or more, so that converters comprising catalytic substrates within the above range are preferred for providing good exhaust gas purifying apparatuses.

Then, since the heat capacity per 1 $cm^3$ of the catalytic substrate in the first exhaust converter and the geometric surface area of the catalytic substrate in the second exhaust converter also depend respectively upon the partition wall thickness and the cell density, the following experiments, Experiments 3 and 4, were conducted with respect to the change of the hydrocarbon HC purification efficiency with changing partition wall thickness and cell density of the catalytic substrates of the first and second exhaust converters.

(Experiment 3)

Figure 6:
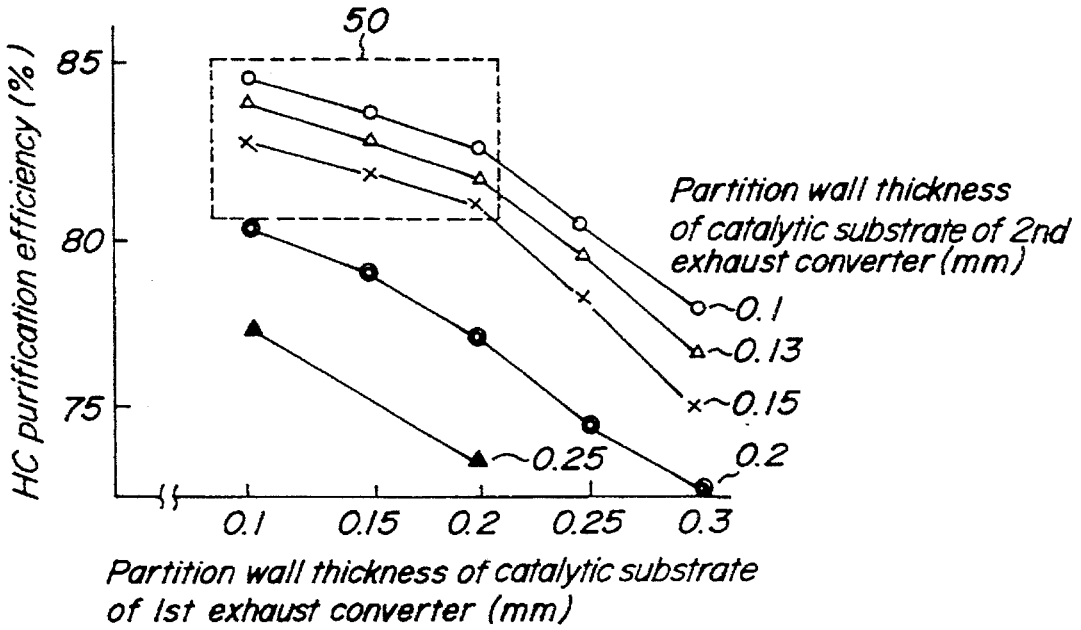
FIG. 6 is a characteristic diagram showing relations of the hydrocarbon HC purification efficiency with the partition wall thickness of the catalytic substrate of the first exhaust converter in conjunction with the partition wall thickness of the catalytic substrate of the second exhaust converter, in the embodiment of the exhaust gas purifying apparatus of the present invention.

FIG. 6 is a diagram showing a result of an experiment wherein changes of the hydrocarbon HC purification efficiency were measured with changing partition wall thicknesses of the catalytic substrates in the first and second exhaust converters, respectively. In both the catalytic substrates of the first and second exhaust converters, only the partition wall thickness was changed while the cell density was kept constant at 65 cells/$cm^2$.

In FIG. 6, it is understood that the hydrocarbon HC purification efficiencies are extremely high in the range surrounded with the dotted line 50 wherein the partition wall thickness of the catalytic substrate in the first exhaust converter is 0.20 mm or less and the partition wall thickness of the catalytic substrate in the second exhaust converter is 0.15 mm or less, so that converters comprising catalytic substrates within the above range are preferred for providing good exhaust gas purifying apparatuses. Moreover, further improved exhaust gas purifying apparatuses were obtained in the range wherein the partition wall thickness of the catalytic substrate in the first exhaust converter was 0.15 mm or less.

(Experiment 4)

Figure 7:
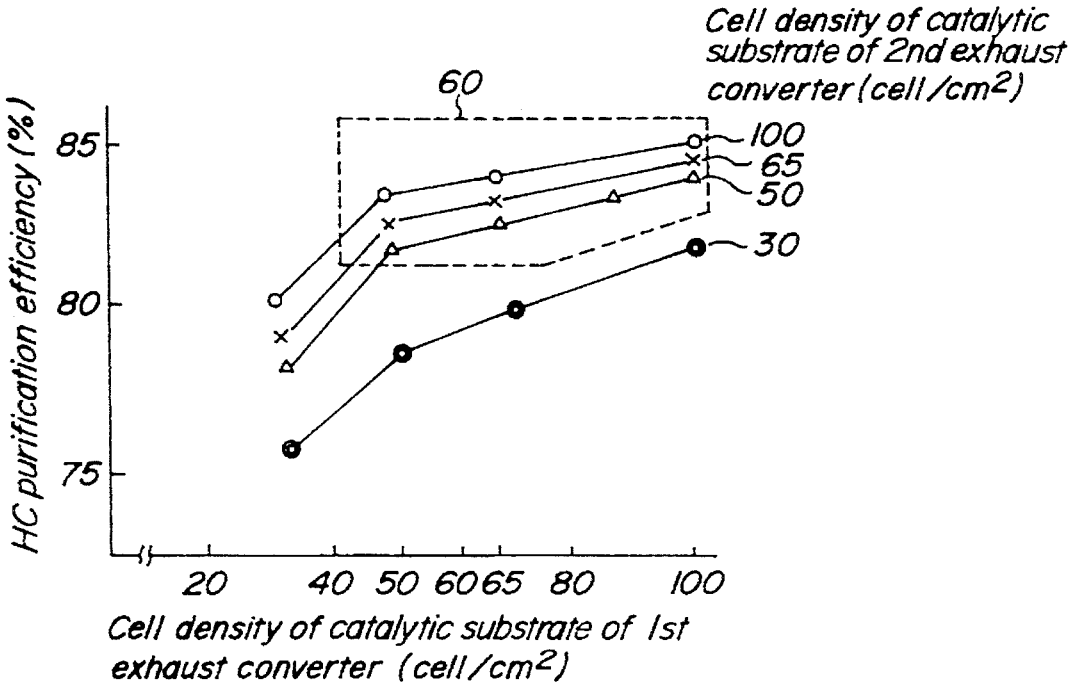
FIG. 7 is a characteristic diagram showing relations of the hydrocarbon HC purification efficiency with the cell density of the catalytic substrate of the first exhaust converter in conjunction with the cell density of the catalytic substrate of the second exhaust converter, in the embodiment of the exhaust gas purifying apparatus of the present invention.

FIG. 7 is a characteristic diagram showing a result of an experiment wherein changes of the hydrocarbon HC purification efficiency were measured with changing cell densities of the catalytic substrates in the first and second exhaust converters, respectively. In the catalytic substrates of the first and second exhaust converters, only the cell density was changed while the partition wall thicknesses were kept constant at 0.15 mm and 0.10 mm, respectively.

In FIG. 7, it is understood that the hydrocarbon HC purification efficiencies are extremely high in the range surrounded with the dotted line 60 wherein the cell densities of the catalytic substrates in the first and second exhaust converters are both 50 cells/$cm^2$ or more, so that converters comprising catalytic substrates within the above range are preferred for providing good exhaust gas purifying apparatuses. Moreover, further improved exhaust gas purifying apparatuses were obtained in the range wherein the cell density of the catalytic substrates in the first and second exhaust converters was 65 cells/$cm^2$ or more.

In FIGS. 3B, 4, 5, 6 and 7 which show the experiment results of the above Experiments 1~4, only the hydrocarbon HC purification efficiencies were shown. However, with respect to carbon monoxide CO and nitrogen oxides $NO_x$, substantially the same results were also obtained in the ranges wherein the exhaust gas purifying apparatus showed a good exhaust gas purification efficiency with respect to hydrocarbons.

In this embodiment, the oxygen sensor 11 is arranged between the exhaust manifold 2 and the first exhaust converter 16, which functions as a gas detector and outputs a signal corresponding to the oxygen partial pressure in the exhaust gas and thus fuel is supplied at an optimal feed rate by means of the engine control computer 12. However, in this invention, another control system may be adopted to omit such a gas detector, in which fuel is supplied at an optimal feed rate, for example, by computing the intake of air from the number of rotations of the engine and the pressure of air in the intake manifold.

Figure 8:
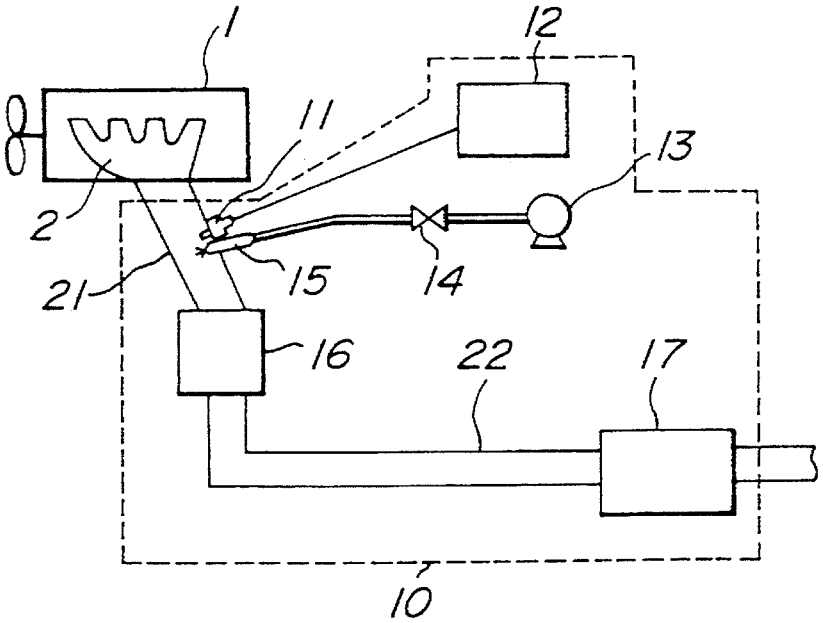
FIG. 8 is a schematic view illustrating an exhaust gas flow route in an engine wherein another embodiment of the exhaust gas purifying apparatus according to the present invention is applied.

FIG. 8 shows an exhaust gas flow route in an engine wherein another embodiment of the exhaust gas purifying apparatus according to the present invention is applied.

In this embodiment, a secondary air introducing inlet 15, as an air introducing device, is arranged between the oxygen sensor 11 and the first exhaust converter 16, through which secondary air is fed into exhaust gas flow in an exhaust pipe 21. Namely, the secondary air is supplied from a pneumatic pump 13 i.e., a supply source through the secondary air introducing inlet 15 into the exhaust pipe 21, at a feed rate being regulated by a pneumatic valve 14. The oxygen sensor 11, the secondary air introducing inlet 15, the first exhaust converter 16 and the second exhaust converter 17 are arranged in this order toward downstream flow of the gas collected by the exhaust manifold 2.

As the oxygen sensor 11, a whole region type Ga/Gf sensor is employed which outputs a signal in proportion to the oxygen partial pressure in the exhaust gas. An engine control computer 12 receives the output signal from the oxygen sensor 11 and determines optimal feed rates of fuel and secondary air. As the oxygen sensor 11 also can be employed a dual signal output type sensor which outputs a rich or lean signal corresponding to the oxygen partial pressure of the exhaust gas. The secondary air introducing inlet 15 may be arranged in either or both of between the exhaust manifold 2 and the oxygen sensor 11 and between the oxygen sensor 11 and the first exhaust converter 16.

The pneumatic pump 13 is driven by power of an output shaft not shown of the engine body 1. According to this manner, the pneumatic pump 13 is driven always during operation of the engine. Therefore, in the case where an excessive oxygen exists in the exhaust gas in the exhaust pipe 21, the pneumatic valve 14 constricts to reduce the feed rate of air, giving an excessive load back to the pneumatic pump 13 which may be prone to damage. In order to avoid the damage and prolong the life of the pneumatic pump 13, use can be made of an electric motor which can drive only for feeding air into the exhaust gas in the exhaust pipe 21.

The pneumatic valve 14 feeds the secondary air into the exhaust gas in the exhaust pipe 21, regulating the feed rate at an optimal value according to the control signal output from the engine control computer 12. Then, in order to optimize the exhaust gas purification efficiency, it is desired that the air excess ratio of the exhaust gas downstream the secondary air introducing inlet 15 is made to be 1.05±0.05.

A process of purifying the exhaust gas discharged from the engine body 1 by the secondary air will be explained hereinbelow.

The exhaust gas discharged from the engine body 1 is collected by the exhaust manifold 2 and transferred into the exhaust pipe 21. The oxygen sensor 11 detects the oxygen partial pressure of the exhaust gas in the exhaust pipe 21 and gives a signal output corresponding to the oxygen partial pressure to the engine control computer 12. According to this output signal, the engine control computer 12 determines a feed rate of fuel and gives an on/off signal to the pneumatic valve 14. The exhaust gas mixed with the optimized quantity of the secondary air flows into the first exhaust converter 16. Then, in order that the nitrogen oxide $NO_x$ purification efficiency may not be deteriorated, it is recommended that the secondary air is fed only for a certain period of time, for example, 10 to 200 seconds, immediately after starting up the engine when large quantities of carbon monoxide CO and hydrocarbons HC and a small quantity of nitrogen oxides NOx are exhausted.

In this embodiment wherein the secondary air introducing inlet 15 for feeding secondary air into the exhaust pipe 21 is arranged between the oxygen sensor 11 and the first exhaust converter 16, a good exhaust gas purification efficiency can be maintained, no matter whether warming up of the engine body 1 immediately after starting up has been completed or not.

Next, experimental data are shown in FIGS. 2, 3, and 9~11.

In Experiments 5~8, the quantity and purification efficiency of exhaust hydrocarbons HC were determined when a 2,000 cc automobile was driven according to the drive pattern shown in FIG. 2. The catalytic substrates of the first and second exhaust converters were both made of cordierite and had constant capacities of 700 $cm^3$ and 1700 $cm^3$, respectively. The secondary air was fed into the exhaust pipe only for 120 seconds after starting up the engine. As an oxygen sensor, a whole region type Ga/Gf sensor was employed. The air excess ratio in exhaust gas at the downstream flow from the secondary air introducing inlet was 1.05±0.05.

Further, in these experiments, the metallic catalysts carried by the substrates were equalized in quantity among all the first exhaust converters and also among all the second exhaust converters, respectively.

(Experiment 5)

The graph 45 shown in FIG. 3B is a plot of the quantity of the hydrocarbon HC exhaust determined under the condition shown in Table 1, Example 3, within the range shown in FIG. 3A. It is understood that the graph 45 of Example 3 shows a quantity of the exhaust hydrocarbons HC lower than those of other examples, Examples 1 and 2 and Comparative Examples 1 and 2.

(Experiment 6)

With changing the heat capacity per 1 $cm^3$ of the catalytic substrate in the first exhaust converter and the geometric surface area of the catalytic substrate in the second exhaust converter, changes of the hydrocarbon HC purification efficiency were measured. With respect to the heat capacity per 1 $cm^3$ of the catalytic substrate in the first exhaust converter, a desired value was obtained by changing the cell density in the range from 65 cells/$cm^2$ to 200 cells/$cm^2$ and the porosity in the range from 7% to 28% while the partition wall thickness was kept constant, in the catalytic substrate. Alternatively, with respect to the geometric surface area of the catalytic substrate in the second exhaust converter, a desired value was obtained by changing the cell density while the partition wall thickness was kept constant at 0.13 mm. The results of the experiments are shown in FIG. 9.

Figure 9:
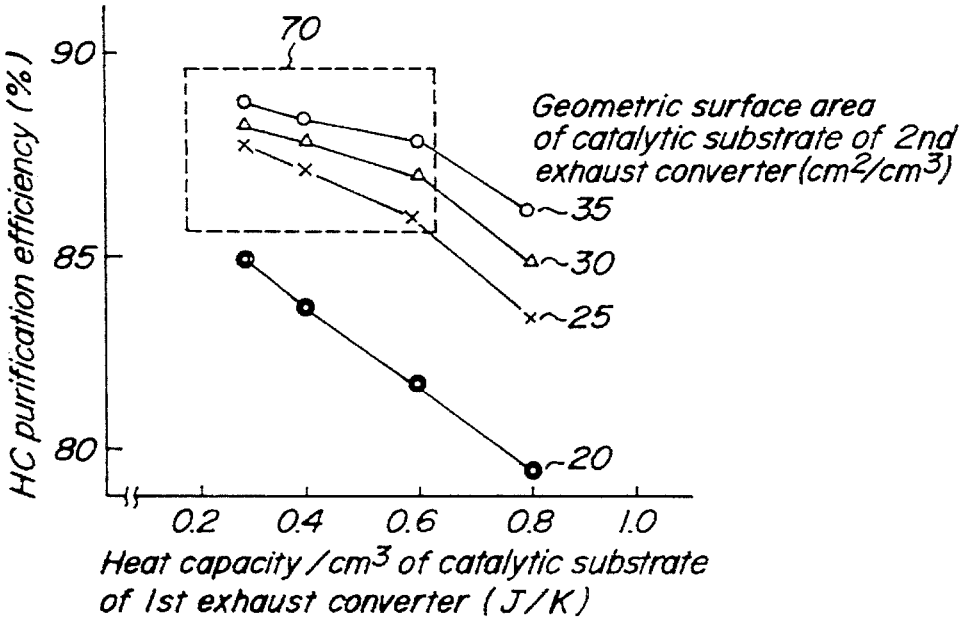
FIG. 9 is a characteristic diagram showing relations of the hydrocarbon HC purification efficiency with the heat capacity per 1 $cm^3$ of the catalytic substrate of the first exhaust converter in conjunction with the geometric surface area of the catalytic substrate of the second exhaust converter, in the other embodiment of the exhaust gas purifying apparatus of the present invention.

In FIG. 9, it is understood that the hydrocarbon HC purification efficiencies are extremely high in the range surrounded with the dotted line 70 wherein the heat capacity per 1 $cm^3$ of the catalytic substrate in the first exhaust converter is 0.6 J/K or less and the geometric surface area of the catalytic substrate in the second exhaust converter is 25 $cm^2/cm^3$ or more, so that converters comprising catalytic substrates within the above range are preferred for providing good exhaust gas purifying apparatuses.

In this experiment, metallic catalysts were used and the heat capacity per unit volume of the substrate with the catalysts was 1.5 times that of the substrate alone. Further, changing the catalyst carrying condition, a catalytic substrate with the catalysts which had a heat capacity per unit volume of the substrate of 1.3 times that of the substrate alone was prepared. This catalytic substrate was tested and the same result was obtained.

Moreover, further improved exhaust gas purifying apparatuses were obtained in the range wherein the heat capacity per 1 $cm^3$ of the catalytic substrate in the first exhaust converter was 0.4 J/K or less and the geometric surface area of the catalytic substrate in the second exhaust converter was 30 $cm^2/cm^3$ or more.

Then, since the heat capacity per 1 $cm^3$ of the catalytic substrate in the first exhaust converter and the geometric surface area of the catalytic substrate in the second exhaust converter also depend respectively upon the partition wall thickness and the cell density, the following experiments, Experiments 7 and 8, were conducted with respect to the change of the hydrocarbon HC purification efficiency with changing partition wall thickness and cell density of the catalytic substrates of the first and second exhaust converters.

(Experiment 7)

Figure 10:
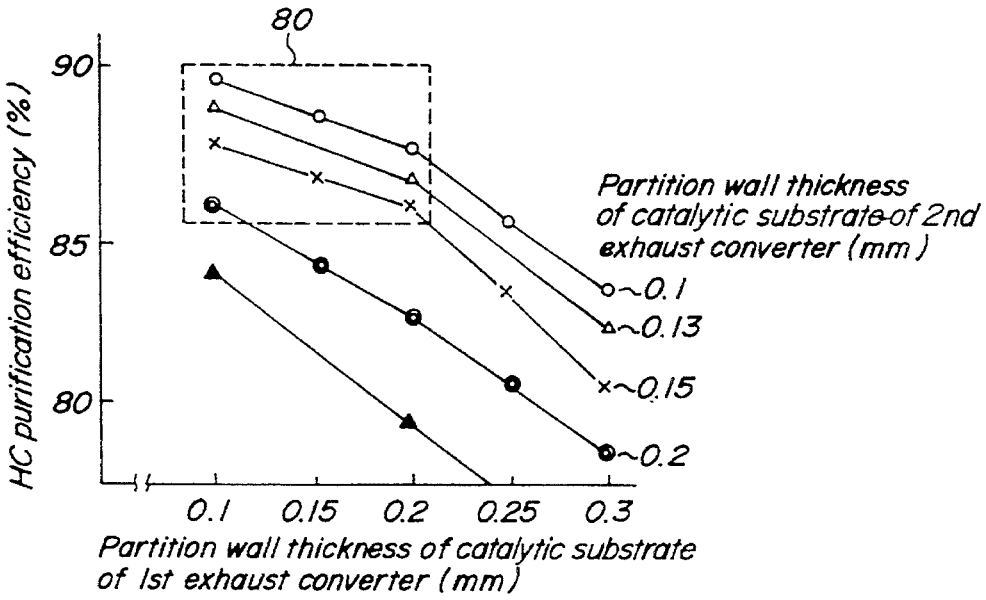
FIG. 10 is a characteristic diagram showing relations of the hydrocarbon HC purification efficiency with the partition wall thickness of the catalytic substrate of the first exhaust converter in conjunction with the partition wall thickness of the catalytic substrate of the second exhaust converter, in the other embodiment of the exhaust gas purifying apparatus of the present invention.

FIG. 10 is a diagram showing a result of an experiment wherein changes of the hydrocarbon HC purification efficiency were measured with changing partition wall thicknesses of the catalytic substrates in the first and second exhaust converters, respectively. In both the catalytic substrates of the first and second exhaust converters, only the partition wall thickness was changed while the cell density was kept constant at 65 cells/cm$^2$.

In FIG. 10, it is understood that the hydrocarbon HC purification efficiencies are extremely high in the range surrounded with the dotted line 80 wherein the partition wall thickness of the catalytic substrate in the first exhaust converter is 0.20 mm or less and the partition wall thickness of the catalytic substrate in the second exhaust converter is 0.15 mm or less, so that converters comprising catalytic substrates within the above range are preferred for providing good exhaust gas purifying apparatuses. Moreover, further improved exhaust gas purifying apparatuses were obtained in the range wherein the partition wall thickness of the catalytic substrate in the first exhaust converter was 0.15 mm or less.

(Experiment 8)

Figure 11:
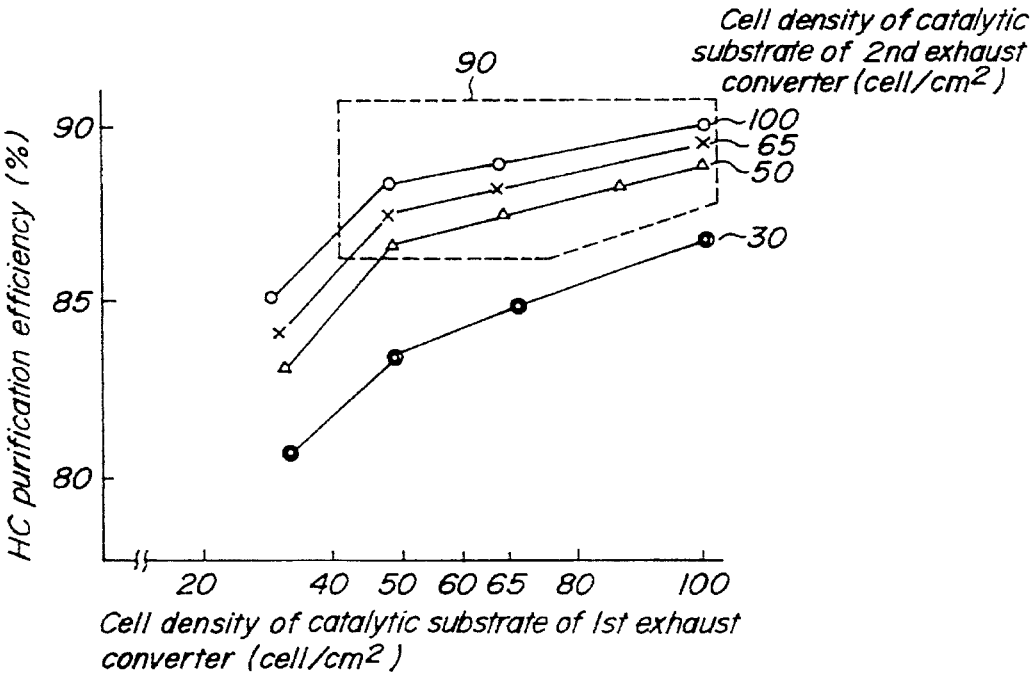
FIG. 11 is a characteristic diagram showing relations of the hydrocarbon HC purification efficiency with the cell density of the catalytic substrate of the first exhaust converter in conjunction with cell density of the catalytic substrate of the second exhaust converter, in the other embodiment of the exhaust gas purifying apparatus of the present invention.

FIG. 11 is a characteristic diagram showing a result of an experiment wherein changes of the hydrocarbon HC purification efficiency were measured with changing cell densities of the catalytic substrates in the first and second exhaust converters, respectively. In the catalytic substrates of the first and second exhaust converters, only the cell density was changed while the partition wall thicknesses were kept constant at 0.15 mm and 0.10 mm, respectively.

In FIG. 11, it is understood that the hydrocarbon HC purification efficiencies are extremely high in the range surrounded with the dotted line 90 wherein the cell densities of the catalytic substrates in the first and second exhaust converters are both 50 cells/cm$^2$ or more, so that converters comprising catalytic substrates within the above range are preferred for providing good exhaust gas purifying apparatuses. Moreover, further better exhaust gas purifying apparatuses were obtained in the range wherein the cell density of the catalytic substrates in the first and second exhaust converters was 65 cells/cm$^2$ or more.

In FIGS. 3B, 9, 10 and 11 which show the experiment results of the above Experiments 5~8, only the hydrocarbon HC purification efficiencies were shown. However, with respect to carbon monoxide CO and nitrogen oxides $NO_x$, substantially the same results were also obtained in the ranges wherein the exhaust gas purifying apparatus showed a good exhaust gas purification efficiency with respect to hydrocarbons.

In this embodiment, the oxygen sensor 11 outputs a signal corresponding to the oxygen partial pressure of the exhaust gas and gives to the engine control computer 12 which thereby regulates the feed rate of secondary air to be fed into the exhaust pipe 21. However, in this invention, it is possible to regulate arbitrarily the feed rate of secondary air to be fed into the exhaust gas without using the oxygen sensor or without regard to the output signals of the oxygen sensor.

Further in this embodiment, the secondary air introducing inlet 15 was arranged between the oxygen sensor 11 and the first exhaust converter 16. However, in the present invention, the secondary air introducing inlet, as an air introducing device, may be arranged anywhere between the exhaust manifold and the first exhaust converter. Thus, it can be arranged in either or both of between the oxygen sensor i.e. a gas detector and the first exhaust converter, or between exhaust manifold outlet and the oxygen sensor.

Furthermore, this embodiment, since it requires a pneumatic pump, pneumatic valve, secondary air introducing inlet or the like, may be structurally complicated and expensive to manufacture. However, it is advantageous in that a high purification efficiency can be obtained as is clear from the above experimental results.

As explained above, in the embodiments of the present invention, at least one additional exhaust converter can be arranged downstream along the exhaust gas flow direction from the second exhaust converter in order to increase the exhaust purification efficiency. Additionally, though in the above embodiments the catalytic substrates of both the first and second exhaust converters were formed from cordierite, only either one of the first and second exhaust converters may comprise a catalytic substrate formed from a ceramic such as cordierite.

Further, in the above embodiments of the present invention, though an oxygen sensor was used as a gas detector, other types of gas detectors, such as hydrocarbons HC detectors or nitrogen oxides $NO_x$ detectors, also can be used in lieu of the oxygen sensor, according to the present invention.

We claim:

1. An exhaust gas purifying apparatus comprising first and second exhaust converters arranged in sequence downstream from an exhaust manifold of an engine in the exhaust gas flow direction, each having a catalytic substrate comprising a honeycomb structure having a plurality of exhaust flow passages defined by partition walls and extending along the axial direction of the catalytic substrate, the catalytic substrate of said first exhaust converter having a heat capacity of not exceeding 0.5 J/K per 1 cm$^3$ in temperature ranging from room temperature up to 300° C., and the catalytic substrate of said second exhaust converter having a geometric surface area of at least 25 cm$^2$/cm$^3$.

2. The apparatus of claim 1, wherein the partition walls defining said exhaust flow passages of the catalytic substrate in said first exhaust converter are not greater than 0.20 mm thick and the partition walls defining said exhaust flow passages of the catalytic substrate in said second exhaust converter are not greater than 0.15 mm thick.

3. The apparatus of claim 1, wherein the number of said exhaust flow passages in the catalytic substrate of both of said first and second exhaust converters is at least 50 per 1 cm$^2$, in a plane perpendicular to the axial direction of said exhaust flow passages.

4. The apparatus according to claim 1, further comprising at least one additional exhaust converter arranged downstream from said second exhaust converter.

5. The apparatus according to claim 1, wherein the catalytic substrate of at least one of said first and second exhaust converters is comprised of a ceramic.

6. The apparatus according to claim 1, further comprising an air introducing device to feed air at a feed rate into exhaust gas flow between said exhaust manifold and said first exhaust converter.

7. The apparatus according to claim 1, further comprising a gas detector arranged between said exhaust manifold and said first exhaust converter, to detect conditions of exhaust gas composition and output a signal for thereby controlling fuel combustion conditions.

8. The apparatus according to claim 7, further comprising an air introducing device to feed air at a feed rate into exhaust gas flow between said exhaust manifold and said gas detector, or between said gas detector and said first exhaust converter.

9. The apparatus according to claim 8, wherein said air introducing device is adapted to feed air at a feed rate which corresponds to the signal output from said gas detector.

10. The apparatus according to claim 7, wherein said gas detector is an oxygen sensor.

* * * * *